US009951395B2

(12) United States Patent
Shimotsu et al.

(10) Patent No.: US 9,951,395 B2
(45) Date of Patent: Apr. 24, 2018

(54) METHOD FOR STRENGTHENING STEEL PLATE MEMBER

(71) Applicant: ASTEER CO., LTD., Soja-shi (JP)

(72) Inventors: Koji Shimotsu, Soja (JP); Katsushi Osumi, Soja (JP); Yukihiro Tsugita, Soja (JP)

(73) Assignee: ASTEER CO., LTD., Soja-shi (JP)

( * ) Notice: Subject to any disclaimer, the term of this patent is extended or adjusted under 35 U.S.C. 154(b) by 522 days.

(21) Appl. No.: 14/359,237

(22) PCT Filed: Mar. 13, 2013

(86) PCT No.: PCT/JP2013/056988
§ 371 (c)(1),
(2) Date: May 19, 2014

(87) PCT Pub. No.: WO2013/137308
PCT Pub. Date: Sep. 19, 2013

(65) Prior Publication Data

US 2015/0299817 A1 Oct. 22, 2015

(30) Foreign Application Priority Data

Mar. 13, 2012 (JP) ..... 2012-055541

(51) Int. Cl.

| | |
|---|---|
| ***C21D 1/18*** | (2006.01) |
| ***C21D 11/00*** | (2006.01) |
| ***C21D 1/34*** | (2006.01) |
| ***C21D 1/673*** | (2006.01) |
| ***C21D 1/40*** | (2006.01) |
| ***C21D 6/00*** | (2006.01) |
| ***C21D 8/02*** | (2006.01) |
| ***C21D 9/46*** | (2006.01) |
| ***C22C 38/00*** | (2006.01) |

(52) U.S. Cl.
CPC ..... *C21D 1/18* (2013.01); *C21D 1/34* (2013.01); *C21D 1/40* (2013.01); *C21D 1/673* (2013.01); *C21D 6/00* (2013.01); *C21D 8/0247* (2013.01); *C21D 8/0294* (2013.01); *C21D 9/46* (2013.01); *C21D 11/005* (2013.01); *C22C 38/00* (2013.01); *C21D 2221/00* (2013.01); *C21D 2221/02* (2013.01)

(58) Field of Classification Search
CPC ..... C21D 1/18
See application file for complete search history.

(56) References Cited

U.S. PATENT DOCUMENTS

| | | | | |
|---|---|---|---|---|
| 6,903,296 | B2 | 6/2005 | Gomez | |
| 2006/0237245 | A1 | 10/2006 | Yoshida | |
| 2011/0283851 | A1* | 11/2011 | Overrath | B21D 22/00 83/15 |
| 2011/0303330 | A1 | 12/2011 | Ichikawa | |

FOREIGN PATENT DOCUMENTS

| | | | |
|---|---|---|---|
| JP | 11-140537 | A | 5/1999 |
| JP | 2006-322065 | A | 11/2006 |
| JP | 2009-061473 | A | 3/2009 |
| JP | 2009-095869 | A | 5/2009 |
| JP | 2011-136342 | A | 7/2011 |
| JP | 2011-255413 | A | 12/2011 |

OTHER PUBLICATIONS

Pawlowski, B. "Critical points of hypoeutectoid steel-prediction of the pearlite dissolution finish temperature Ac1f." Journal of Achievements in Materials and Manufacturing Engineering 49.2 (2011): 331-337.*

George, R., A. Bardelcik, and M. J. Worswick. "Hot forming of boron steels using heated and cooled tooling for tailored properties." Journal of Materials Processing Technology 212.11 (2012): 2386-2399.*

* cited by examiner

*Primary Examiner* — Jessee R Roe
*Assistant Examiner* — Jophy S. Koshy
(74) *Attorney, Agent, or Firm* — Fox Rothschild LLP

(57) ABSTRACT

Provided is a method for strengthening a steel plate member employing a heating and quenching treatment. The method includes a first heating step, a partial cooling step, a second heating step and an entire cooling step, each step conducted in the written order.

8 Claims, 11 Drawing Sheets

METHOD FOR STRENGTHENING STEEL PLATE MEMBER

TECHNICAL FIELD

The present invention relates to a method for partially strengthening a steel plate member by partial hardening.

BACKGROUND ART

High-tensile steel plates are used for automobiles to reduce their weight. A high-tensile steel plate has an increased strength compared with ordinary steel plates. It is strengthened by adding alloy components, controlling a structure or others. Although definition of a high-tensile steel plate differs depending on the country and the manufacturer, the one having a strength of approximately 490 MPa or higher is referred to as a high-tensile steel. By using a high-tensile steel plate, it is possible to ensure sufficient strength with a thin or small steel plate member. A high-tensile steel plate is poor in formability and workability because of its high strength. Therefore, it is difficult to ensure high accuracy in forming or in subsequent working. In addition, the durability of a die used in forming or subsequent working tends to deteriorate.

In light of these problems, an ordinary steel plate softer than a high-tensile steel plate is formed or worked and then conducting a heating and quenching treatment. Also, a steel plate heated by a heat of the heating and quenching treatment is formed or worked. The latter working method is called a hot-press working. According to these methods, it is possible to satisfy both excellent formability, workability and strength.

Partial strengthening of a steel plate member by the heating and quenching treatment is classified roughly into a method of partially hardening a part of a steel plate to strengthen only the part, and a method of partially preventing hardening of a part of a steel plate by suppressing temperature rise in the part though the entire steel plate is heated. In the present description, a part that is partially hardened in the steel plate is called a strengthened part, and a part that is not hardened is called a non-strengthened part. Such uneven strengthening of a steel plate member aims at preventing an ununiform distribution of stress generated by external force, facilitating appropriate deformation for absorbing or letting out the external force, and obtaining a soft part for post workings such as piercing or trimming. In case of partial hardening, induction hardening, according to which a strengthened part is easily designated, is utilized (Patent Document 1). In case of partially preventing hardening, a method of suppressing temperature rise of a non-strengthened part is utilized (Patent Document 2 to Patent Document 4).

Patent Document 2 discloses a method of conducting hardening by applying current between electrodes connected to a steel plate (hereinafter, referred to as direct energization heating). In this method, a non-strengthened part is not hardened though the steel plate is entirely heated (1) by contacting a block having higher conductivity than the steel plate and partly diverting the current to the block to prevent a temperature rise of the non-strengthened part (FIG. 1 to FIG. 3 in Patent Document 2); (2) by spraying a cooling gas to suppress temperature rise in the non-strengthened part (FIG. 4 to FIG. 6 in Patent Document 2), or (3) by contacting a ceramics block and others having lower conductivity than the steel plate and absorbing the heat of the non-strengthened part to suppress temperature rise (FIG. 7 to FIG. 8 in Patent Document 2).

Patent Document 3 discloses a hardening method too in which a non-strengthened part is not hardened though the steel plate is entirely heated. In this method, a non-strengthened part of a steel plate is sandwiched by a heat insulating materials. The steel plate and the heat insulating materials are put into an electric furnace. Then, by heating the non-strengthened part to less than a transformation end temperature ($AC_3$) and heating the remaining strengthened part to the transformation end temperature ($AC_3$) or higher, the steel plate is partially strengthened ([claim 1] of Patent Document 3). The steel plate taken out of the electric furnace is subjected to a press working (hot press working) for cooling, or further subjected to a post working ([claim 3] of Patent Document 3). Rock wool, glass wool, ceramic fiber, and heat resistant brick are exemplified as heat insulating materials (Patent Document 3, [0026]).

In patent Document 4, a temperature control member is brought into contact with a non-strengthened part of a steel plate in the course of heating the steel plate in order to control the non-strengthened part to a transformation start temperature ($AC_1$) or less. The temperature control member is formed of a nonconductive material, and is controlled to the same temperature as the steel plate under heating ([claim 3], [claim 5], [0029] of Patent Document 4). As a heating method, direct energization heating is exemplified ([claim 4] and others of Patent Document 4). While the method of Patent Document 4 is stated as a solution for the problem of the method of Patent Document 3, it can also be regarded as improvement of the above (3) disclosed in Patent Document 2.

CITED DOCUMENTS

Patent Document

Patent Document 1: JP 11-140537 A
Patent Document 2: U.S. Pat. No. 6,903,296
Patent Document 3: JP 2009-061473 A
Patent Document 4: JP 2011-136342 A

SUMMARY OF INVENTION

Technical Problem

In terms of providing a strengthened part by partially hardening a steel plate, the method of Patent Document 1 is preferred, and there is not much significant problems. On the other hand, the methods disclosed in Patent Document 2 to Patent Document 4, in which a non-strengthened part is not hardened though the steel plate is entirely heated, respectively have the following problems.

As for Patent Document 2, in the method (1) of using a block having higher conductivity than the steel plate, the current is biased around the part where the block is pushed on to give a part where heating is facilitated by the direct energization and a part where heating is suppressed, to result in uneven hardening. In the method (2) of spraying cooling gas, it is difficult to strictly controlling the non-strengthened part because the cooling gas is sprayed to the part other than the non-strengthened part. In the method (3) of using a block having lower conductivity than the steel plate, it is difficult to keep a temperature of the non-strengthened part at lower than transformation start temperature ($AC_1$) because the block itself may be heated. The block absorbs the heat while the steel plate is entirely heated if it is tried to absorb the heat with the block while the steel plate is entirely heated. There is also a problem in durability of the block.

In the method of Patent Document 3, a steel plate is heated with radiant heat by a high-temperature atmosphere in an electric furnace ([claim 2] in Patent Document 3). The heat insulating material suppresses temperature rise of the non-strengthened part by blocking the radiant heat. However, in case the non-strengthened part sandwiched by the heat insulating material is extremely smaller than the strengthened part that is not sandwiched by the heat insulating material, heat transfers from the strengthened part to the non-strengthened part, because the heating time in the electric furnace is long (900° C., 210 seconds). This results in hardening the non-strengthened part too. Further, productivity is low since the heating time in the electric furnace is long.

The method of Patent Document 4 solves the problem of Patent Document 3, and also solves the problem of method (3) of Patent Document 2. However, in case the hot press working according to an embodiment described in Patent Document 4 is conducted, it is necessary to bring a die into contact with the heated steel plate immediately after completion of a heating because it is rapidly cooled by contacting with the die. However, it inevitably requires a time to sandwich the heated steel plate with a die after removing the temperature control member and proceed to a rapid cooling. This causes temperature rise in the non-strengthened part before conducting the hot press working. As a result, the non-strengthened part is strengthened more than a little. Furthermore, the device configuration and temperature control are complicated.

The methods of Patent Document 2 to Patent Document 4 have the problems as described above, and need to be improved. The method of the present invention provides the method in which a temperature rise in the non-strengthened part is suppressed, uneven strengthening around the non-strengthened part is prevented, and it is possible to shift to the hot press working immediately after completion of heating without increasing the temperature of the non-strengthened part.

Solution to Problem

A method for strengthening a steel plate member employing a heating and quenching treatment. The method includes a first heating step, a partial cooling step, a second heating step and an entire cooling step. Each step is conducted in a written order. In the first heating step, an entire of a steel plate is heated to a non-quenching temperature (NQT) set at lower than a transformation start temperature ($AC_1$), then a heating is once suspended. In the partial cooling step, a non-strengthened part of the steel plate is cooled while the heating is suspended to generate a temperature difference between a strengthened part and the non-strengthened part with reference to a temperature difference (ΔT) determined by subtracting the non-quenching temperature (NQT) from a quenching temperature (QT) set at higher than or equal to a transformation end temperature ($AC_3$). In the second heating step, the entire of the steel pate is again heated until the strengthened part of the steel plate reaches the quenching temperature (QT) while the non-strengthened part remains at lower than the transformation start temperature ($AC_1$), and stopping the heating, followed by the entire cooling step. In the entire cooling step, the entire of the steel plate is rapidly cooled while heating is stopped, to thereby hardening the strengthened part but not hardening the non-strengthened part.

The method for strengthening a steel plate member of the present invention is characteristic in that the heating step, which is a single step in conventional similar methods (for example, Patent Document 2 to Patent Document 4), is divided into a first heating step and a second heating step, and a partial cooling step is conducted between the first heating step and the second heating step. In the partial cooling step, only the non-strengthened part is cooled while heating of the steel plate is suspended to make the temperature of the non-strengthened part lower than the temperature of the strengthened part. Since heating of the steel plate is suspended, it is possible to cool in a short time. In the partial cooling step, since the non-strengthened part is cooled so that temperature difference arises between the strengthened part and the non-strengthened part with reference to the temperature difference (ΔT) determined by subtracting the non-quenching temperature (NQT) from the quenching temperature (QT), the non-strengthened part does not exceed the transformation start temperature ($AC_1$) in the second heating step. The expression "with reference to the temperature difference (ΔT)" means that, for example, if QT=930° C., NQT=800° C., $AC_1$=810° C. and temperature rising rate of the second heating step=20° C./second, ΔT is 130° C. In this case, the non-strengthened part is not necessarily cooled by just 130° C. in the partial cooling step. The cooling temperature may be, for example, 150° C. In this example, 6.5 seconds are required for the strengthened part to reach QT=930° C. from NQT=800° C. On the contrary, since the temperature of the non-strengthened part is 670° C. at the starting point of the second heating step, the temperature after heating at 20° C./second for 6.5 seconds is 800° C. which is lower than $AC_1$ by 10° C. In this case, by setting the temperature difference between the strengthened part and the non-strengthened part at 150° C. to secure a margin, temperature of the non-strengthened part becomes lower than $AC_1$ by 30° C. This makes possible to prevent the non-strengthened part from being unintentionally hardened.

The non-quenching temperature (NQT) is a target temperature when heating in the first heating step, which is set at lower than the transformation start temperature ($AC_1$).

The quenching temperature (QT) is a target temperature when heating in the second heating step, which is set at the transformation end temperature ($AC_3$) or higher. The temperature difference between the strengthened part and the non-strengthened part, which is generated in the partial cooling step, is maintained at almost same extent in the second heating step since the temperature rising rate is substantially equal. Therefore, the non-quenching temperature (NQT) may be set at almost same temperature as the transformation start temperature ($AC_1$). However, in case the heating time lasts long, in such cases that a temperature retaining step, in which the steel plate is held at a constant temperature of $AC_3$ or higher, is conducted after the second heating step; the entire cooling step is not conducted immediately after the second heating step due to delay in operation and others: heat would transfer from the strengthened part having relatively high temperature to the non-strengthened part to decrease the temperature difference. Therefore, it is preferable that the non-quenching temperature (NQT) is set at a temperature lower than the transformation start temperature ($AC_1$) to leave a margin. The transformation start temperature ($AC_1$) and the transformation end temperature ($AC_3$) are set depending on the composition of the steel plate. The quenching temperature (QT) is determined depending on the specification of the heating device, the transformation end temperature ($AC_3$) of the steel plate and others.

It is preferable that an end surface of a cooling block contacts with the non-strengthened part of the steel plate while the heating is suspended to make the cooling block absorb heat and to cool the non-strengthened part with reference to the temperature difference (ΔT), and the cooling block displaces to a position away from the steel plate after completing a cooling. Nonconductive and highly heat conductive material (such as ceramics) or a conductive and highly heat conductive material (copper, iron and so on) can be used as the cooling block. Since heating of the steel plate is suspended, the cooling block deprives the heat therefrom to rapidly cool the non-strengthened part. If the cooling block has an end surface equal to a shape of the non-strengthened part, heat is absorbed only in the region of the non-strengthened part. If cooling block has a configuration that a cooling medium circulates therein, the cooling is reliably finished in a short time even though the temperature difference (ΔT) is a large value.

In the first heating step, an entire of the steel plate is heated to the non-quenching temperature (NQT). The heating time may be shorter or longer. Therefore, in the first heating step, heating is performed by an electric furnace, high-frequency induction heating, direct energization heating and others. On the contrary, it is desired that the second heating step last for as short a time as possible for preventing temperature rise of the cooled non-strengthened part. Therefore, it is desired that in the second heating step, the steel plate be heated by direct energization heating. In this case, by utilizing the direct energization heating also in the first heating step, it is possible to conduct the first heating step and the second heating step with the same heating device without necessity of translocating the steel plate.

In the method of the present invention, since the cooling block used for cooling the non-strengthened part can be displaced away from the steel plate before conducting the second heating step, it is possible to conduct a treatment required for rapidly cooling the steel plate, such as contacting a die for press forming and cooling, after the second heating step. In other words, a hot press working, according to which the steel plate is cooled and press formed at the same time, is preferably adapted in the entire cooling step. Part of the die used in the press forming may be as the cooling block in the partial cooling step. In this case, by circulating the cooling medium inside the cooling block, it is possible to sufficiently cool the cooling block by end of the second heating step to rapidly cool the steel plate when conducting hot press working.

Advantageous Effect of Invention

In the present invention, the conventional heating step is divided into a first heating step and a second heating step. A partial cooling step is conducted between the both steps. In the partial cooling step, the non-strengthened part is cooled with reference to the temperature difference (ΔT) so that the non-strengthened part remains at less than transformation start temperature ($AC_1$) if the temperature of the non-strengthened part rises in the second heating step. The partial cooling step does not become rate-limiting step because it requires a short time.

If the cooling block is used in the partial cooling step, it is possible to cool the non-strengthened part by bringing the end surface into contact with the steel plate. After completing cooling, it is possible to easily displace the cooling block away from the steel plate before conducting the second heating step. Therefore, by using a cooling block, it is possible to shift to the second heating step immediately after finishing the partial cooling step. In the method of the present invention, since a boundary between the non-strengthened part and the strengthened part clearly appears in the part where the edge of the cooling block contacts the steel plate, it is possible to differentially form the non-strengthened part and the strengthened part as preliminarily designed, by using the cooling block having an end surface equal to the non-strengthened part. Further, by circulating the cooling medium inside the cooling block, temperature rise of the cooling block is suppressed to cool the non-strengthened part in a short time. Since it is possible to shift to the second heating step before a heat transfers from the surrounding strengthened part and the temperature rises in the non-strengthened part, the temperature difference between the non-strengthened part and the strengthened part can be kept.

In the second heating step, if the temperature rising rate is increased by using direct energization heating, it is possible to shorten the time for the strengthened part to reach the quenching temperature (QT). If the cooling block is displaced away from the steel plate and held in a position not interfering with something before conducting the second heating step, it is possible to shift to the entire cooling step immediately after finishing the second heating step. Therefore, it is possible to rapidly cool the steel plate with a die of the hot press working and others before the temperature of the non-strengthened part increases due to heat conduction with a lapse of time or before the strengthened part is cooled. Namely, since the entire process is conducted in a very short time, heat conduction can be substantially ignored.

DESCRIPTION OF EMBODIMENT

Figure 1:
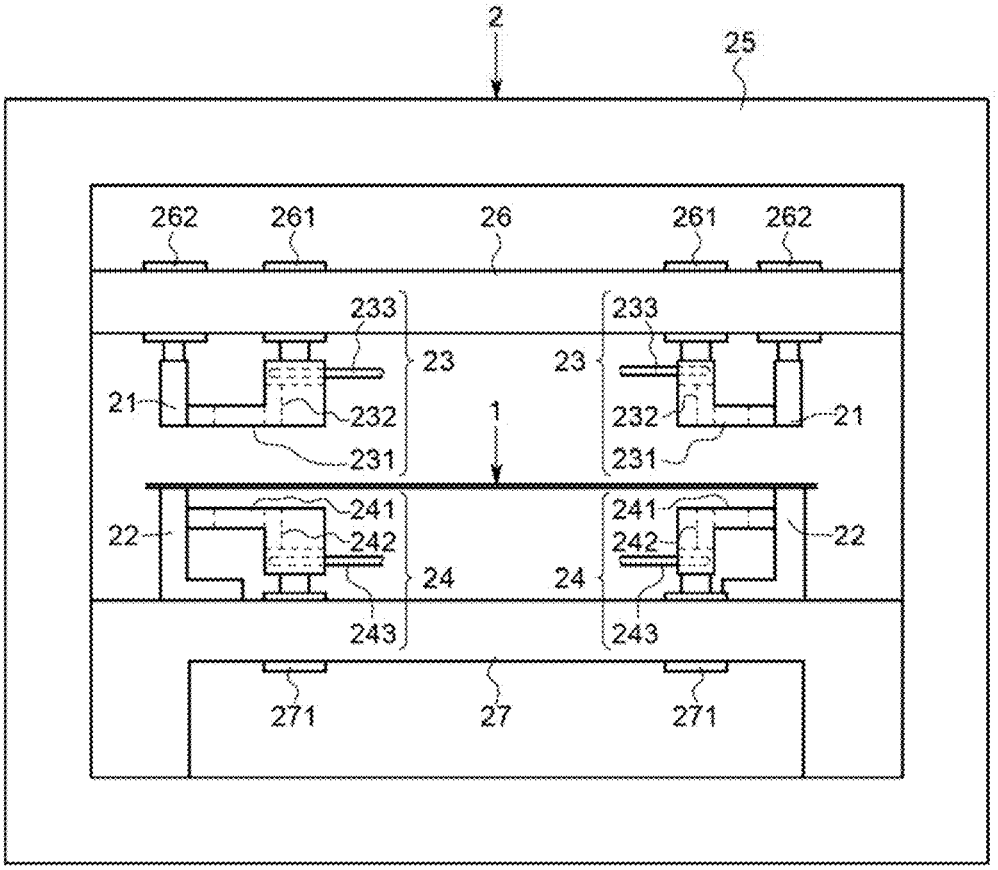
FIG. 1 is a front view illustrating one embodiment of a heating device used in the strengthening method of the present invention.
Figure 2:
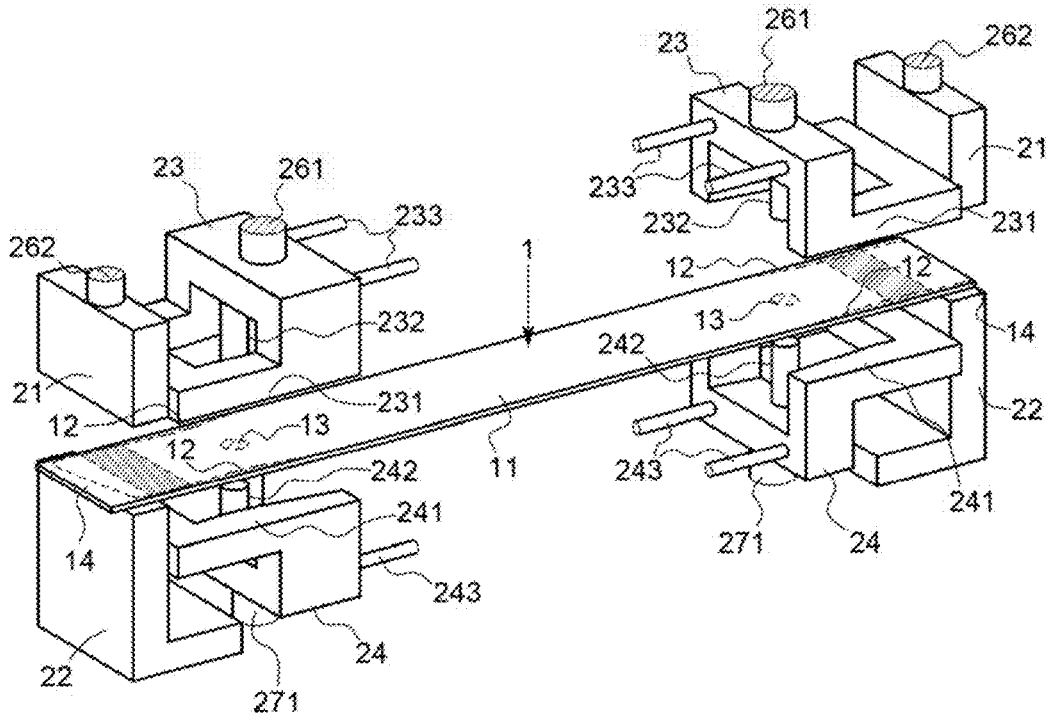
FIG. 2 is an enlarged perspective view illustrating a major part of the heating device in which a steel plate to be strengthened is set.

One embodiment of a device used in the method of the present invention is described below with reference to the drawings. The method for strengthening a steel plate member of the present invention is conducted with a heating device 1 including upper electrodes 21, 21 and lower electrodes 22, 22, upper cooling blocks 23, 23 and lower cooling blocks 24, 24, as illustrated in FIG. 1 and FIG. 2. The upper electrode 21 and the lower electrode 22 form an electrode. Current is applied between the right and left electrodes to heat the steel plate 1 in the first heating step and the second heating step (see FIG. 5). In the present embodiment, after finishing the second heating step, the steel plate 1 is conveyed to a pressing machine which is separately provided and subjected to hot press working corresponding to the entire cooling step to produce an impact beam 3 (see FIG. 8 and FIG. 9).

The heating device 2 used in the present embodiment supports the upper electrodes 21, 21 and the upper cooling blocks 23, 23 in a vertically movable manner with respect to a beam 26 which is laid across struts of a device frame 25 having a rectangular shape when viewed from the front. The lower cooling blocks 24, 24 are supported by a base 27 fixed to the bottom side of the device frame 25 in a vertically movable manner. The lower electrodes 22, 22 are also fixed to the base 27. The steel plate 1 is laid across the right and left lower electrodes 22, 22. In heating the steel plate 1, the upper electrodes 21,21 are lowered from above the steel plate 1 to hold the steel plate 1. Current flows between the right and left electrodes. In cooling the steel plate 1, the upper cooling blocks 23, 23 are lowered from above the steel plate 1 and the lower cooling blocks 24, 24 are elevated from below the steel plate 1. Non-strengthened parts 12, 13 (the region hatched in FIG. 4) of the steel plate is held by end surfaces of the upper and lower cooling blocks 23, 24, 23, 24 and cooled.

The upper electrode 21 is a rectangular metal block. The lower end surface of the metal block abuts on the surface of the steel plate 1. The upper electrode 21 is supported by a rod of a cylinder 262. The cylinder 262 is supported by the beam 26 via an outer tube. The lower electrode 22 is a metal block having a shape of a letter L when viewed laterally, and is fixed to the base 27. The upper end surface of the perpendicular part of the metal block abuts on the back surface of the steel plate 1. In the steel plate 1, current flows only between left and right electrodes 21, 22, 21, 22. In FIG. 2 and others, the region where current flows is illustrated with broken lines. The part that is not cooled in this region is called a strengthened part 11. Non-strengthened parts 14,14, which become attachment parts of the beam (both end parts of the steel plate neighboring the hatched part in FIG. 2 and FIG. 4), are not heated because current does not flow therein.

The upper cooling block 23 is a metal block having a shape of letter L when viewed laterally. The upper cooling block 23 is supported by a rod of a cylinder 261. The cylinder 261 is fixed to the beam 26 via an outer tube. The lower cooling block 24 is also a metal block having a shape of reversed letter L when viewed laterally. The lower cooling block 24 is supported by a rod of a cylinder 271. The cylinder 271 is fixed to the base 27 via an outer tube. If the lower cooling block 24 always contacts the steel plate 1, it causes the current to be biased to result in an uneven hardening and prevents temperature from rising. Therefore, the lower cooling block are displaced away from the steel plate when not conducting the partial cooling step.

Figure 3:
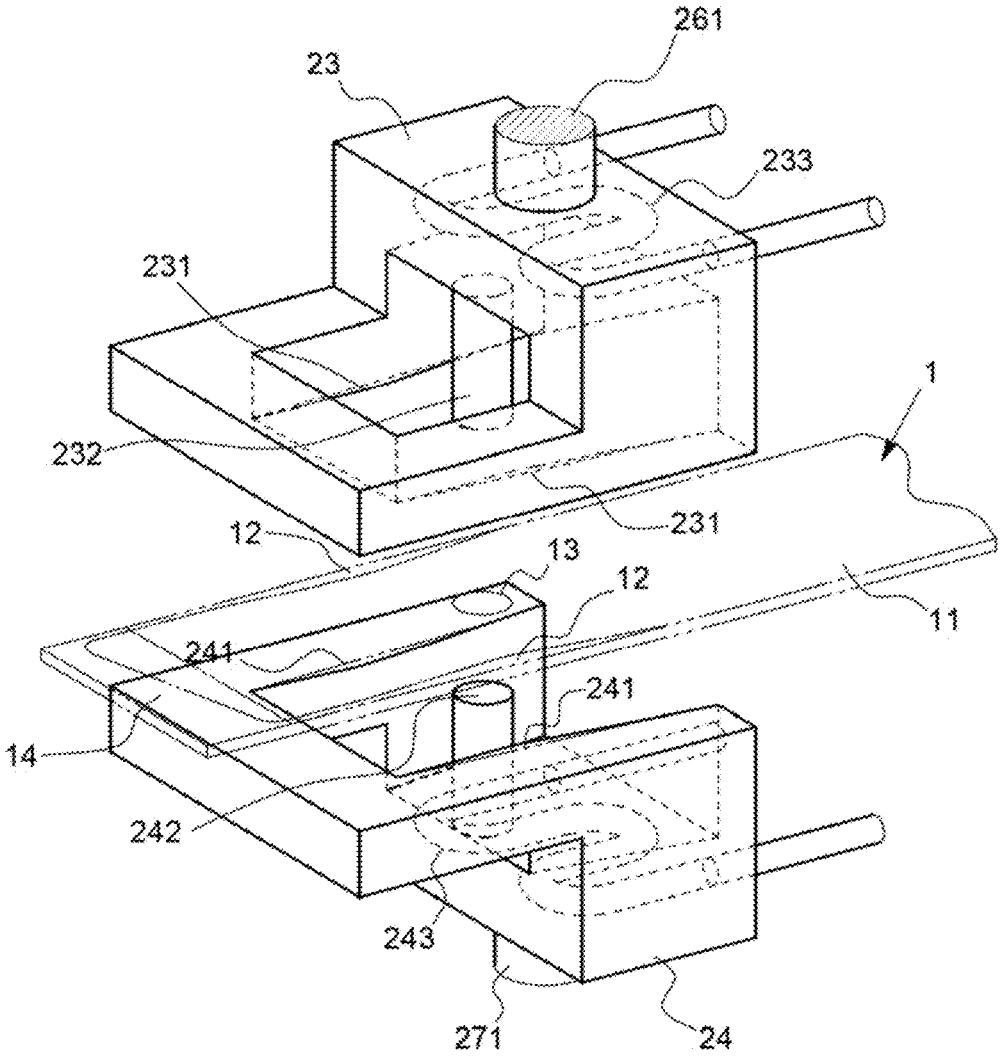
FIG. 3 is a partially enlarged perspective view illustrating an upper cooling block and a lower cooling block.
Figure 4:
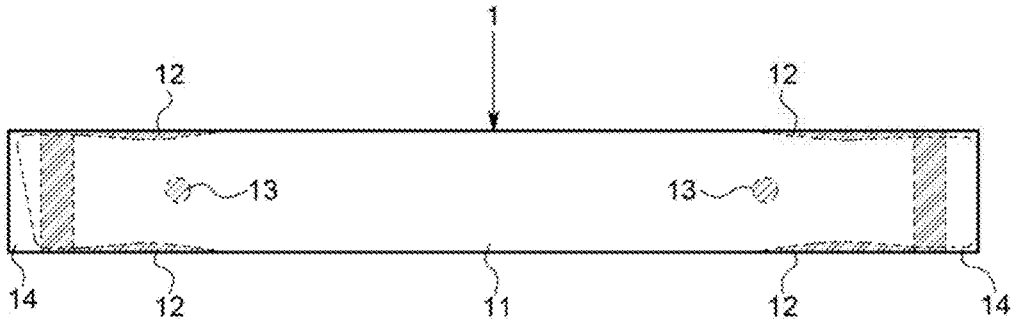
FIG. 4 is a plan view illustrating a strengthened part and a non-strengthened part of a steel plate.
Figure 8:
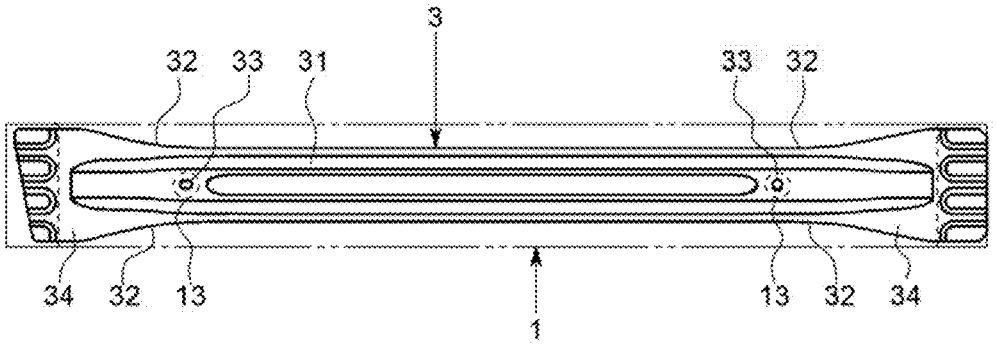
FIG. 8 is a plan view illustrating an impact beam after hot press working.

As illustrated in FIG. 3, the upper cooling block 23 includes cooling parts 231,231 for lateral edges of the steel plate 1 and a cooling part 232 for through-hole to be provided in the steel plate 1. The cooling part 231 has a shape protruding toward the center line of the steel plate 1 so as to follow the profile of the impact beam to form the non-strengthened part 12 in the steel plate. As described above, since current does not flow at end parts of the steel plate 1, the non-strengthened part 14 is formed. Of the non-strengthened part 14 and the non-strengthened part 12, the parts neighboring the non-strengthened part 14 corresponds to attachment parts 34, 34 of impact beam as illustrated in FIG. 4 and FIG. 8. The cooling parts 232, 242 have a cylindrical shape. The upper electrode 21 and the lower electrode 22 are omitted and the steel plate 1 is indicated by a virtual line in FIG. 3.

The upper cooling block 23 is slidably abutted on the lateral surface of the upper electrode 21. Therefore, the lateral surface of the upper electrode 21 functions as a guide in vertical movement of the upper cooling block 23. Since both of the upper electrode 21 and the upper cooling block 23 are metal blocks, either or both of the lateral surfaces of the upper electrode 21 and upper cooling block 23 are insulated. Since it is not necessary for the upper cooling block 23 to be conductive, a ceramics block may be used in place of a metal block. If the upper cooling block 23 made of ceramics, an insulating treatment is not needed. The lower electrode 22 and the lower cooling block 24 may also be configured similarly to the upper electrode 21 and the upper cooling block 23.

As illustrated in FIG. 3, the upper cooling block 23 incorporates a conduit 233. The conduit is arranged in such a manner that it snakes through the cooling block to pass a cooling medium such as water therethrough. By using a cooling medium, it is possible to cool the steel plate rapidly and to reduce the time required for the partial cooling step. Similarly, the lower cooling block 24 incorporates a conduit 243 for cooling medium. Regarding the upper cooling block 23 and the lower cooling block 24, the metal blocks are configured to be sufficiently large compared with the size (area) of the end surfaces of the cooling parts 231, 241, 232, 242. As a result, it is possible to uniformly and rapidly cool the non-strengthened parts 12, 13 against which the end surfaces of the cooling parts 231, 241, 232, 242 abut.

An implementing procedure of the present invention is explained with reference to impact beam illustrated in FIG. 4 as an example. In the present embodiment, the middle part of the steel plate 1 is set as the strengthened part 11. The left and right end parts of the steel plate 11 are respectively set as the non-strengthened parts 14, 14. The non-strengthened parts 14, 14 are cut out along the dashed line in FIG. 4 to form attachment parts for beam. The non-strengthened part 12 is set in a part next to the non-strengthened part 14 and the edge of the steel plate so that it adjoins the non-strengthened part 14. The non-strengthened part 13 for a through-hole 33 is set inside the non-strengthened part 12. Although the non-strengthened parts 12, 12 are in the area where an electricity flows, hardening is prevented by the partial cooling step.

Figure 5:
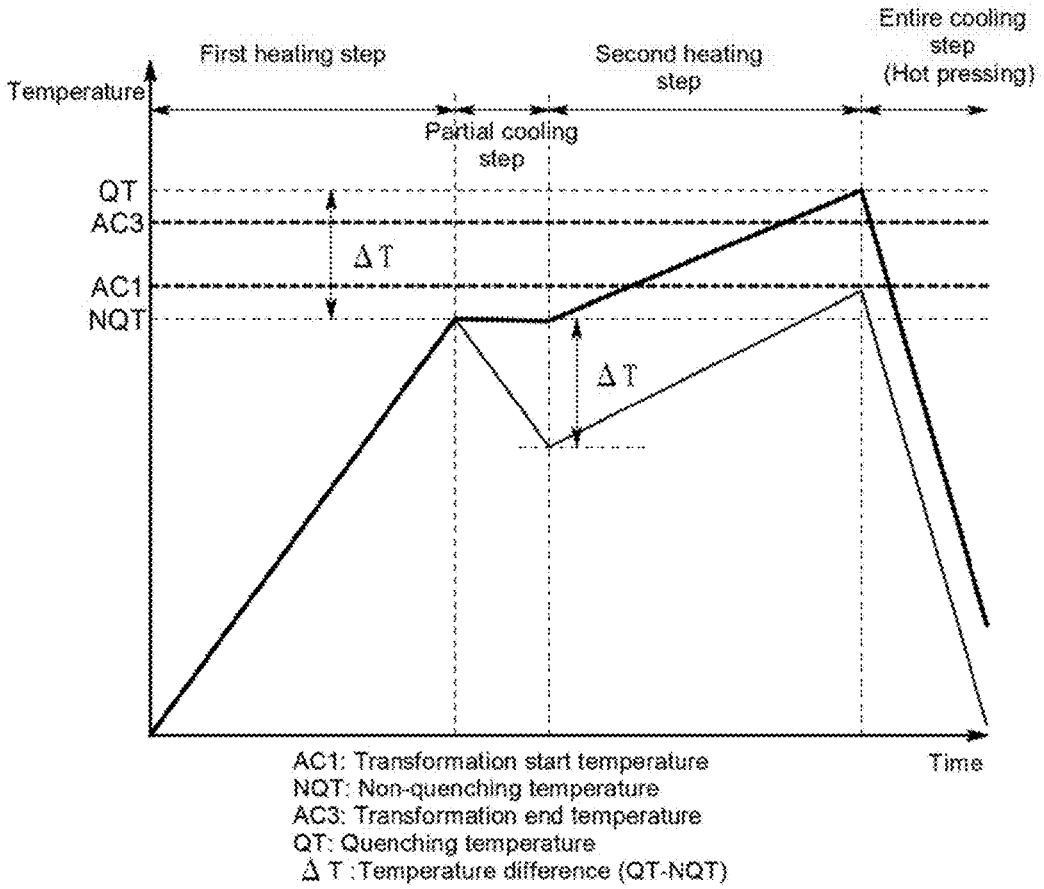
FIG. 5 is a graph showing temperature change in one embodiment of the strengthening method of the present invention.
Figure 6:
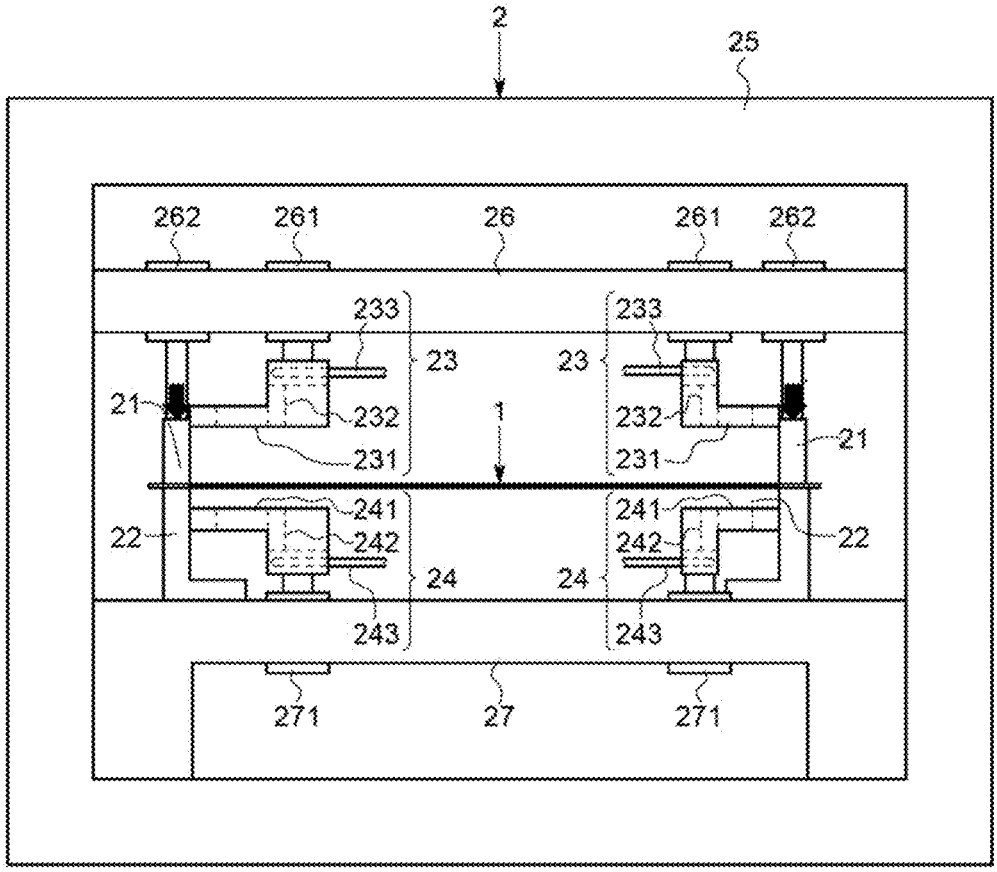
FIG. 6 is a front view corresponding to FIG. 1 illustrating a state in which the first heating step (second heating step) is conducted.

In the first heating step, as illustrated in FIG. 6, the left and right upper electrodes 21, 21 are lowered to sandwich the steel plate 1 with the left and right lower electrodes 22, 22 and the left and right upper electrodes 21, 21. Then the strengthened part 11 of the steel plate is energized, and the steel plate 1 is entirely heated to the non-quenching temperature (NQT) as shown in the graph of FIG. 5. The non-quenching temperature (NQT) is a temperature less than the transformation start temperature ($AC_1$). In the first heating step, the strengthened part 11, the non-strengthened part 12 and the non-strengthened part 13 for a through-hole are entirely heated to the non-quenching temperature (NQT), except for the non-strengthened part 14 which is not energized. Temperatures of the strengthened part 11 and the non-strengthened parts 12, 13 are individually measured by a non-contact type temperature sensor to monitor whether or not temperature of the entire steel plate 1 is evenly raised.

Figure 7:
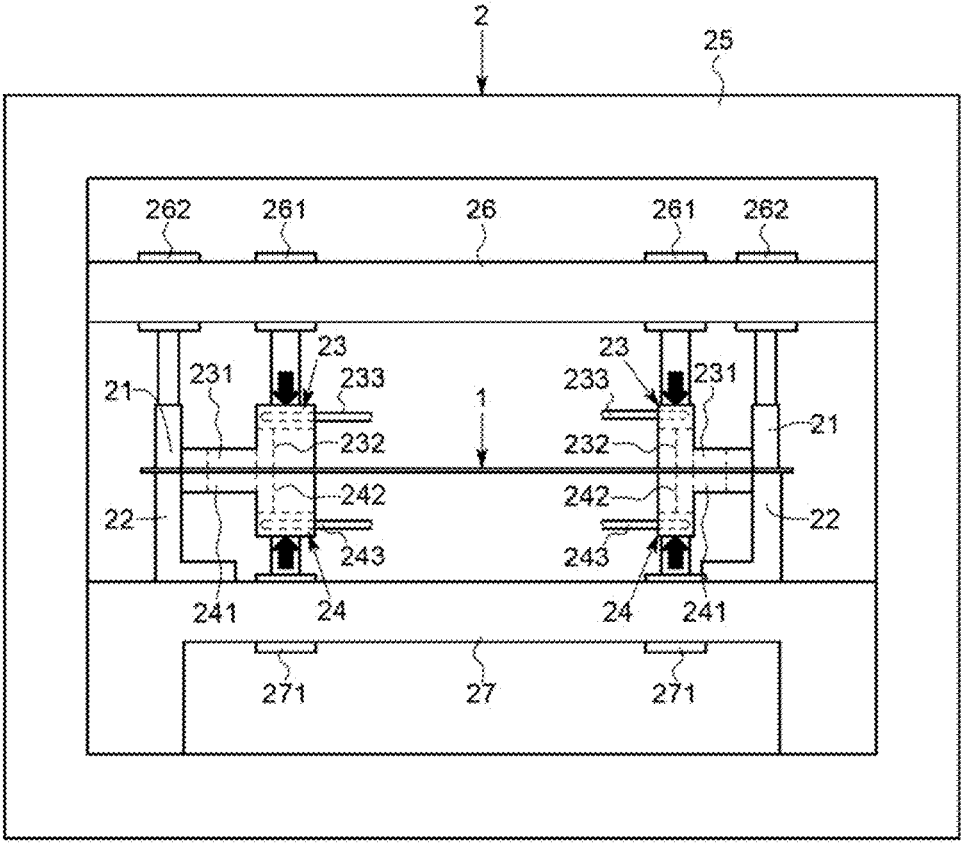
FIG. 7 is a front view corresponding to FIG. 1 illustrating a state in which the partial cooling step is conducted.

In the partial cooling step, as illustrated in FIG. 7, the left and right upper cooling blocks 23 and the left and right lower cooling blocks 24 are displaced in the directions of arrows to sandwich the steel plate 1. Energization to the upper electrode 21 and the lower electrode 22 is made to be suspended to suspend heating. At this time, the upper electrode 21 and the lower electrode 22 may remain abutting against the steel plate 1. The upper cooling block 23 and the lower cooling block 24 are brought into contact with the non-strengthened parts 12,13 and the non-strengthened parts 12, 13 are partially cooled with reference to the temperature difference (ΔT) calculated by the following expression. FIG. 5 shows temperature change of the steel plate 1. In FIG. 5, the bold line represents temperature change of the strengthened part 11, and the thin line represents temperature change of the non-strengthened parts 12,13.

Temperature Difference (ΔT)=
Quenching Temperature (QT)−
Non-Quenching Temperature (NQT) [Numerical expression 1]

In the second heating step, the left and right upper cooling blocks 23, 23 are elevated, and the left and right lower cooling blocks 24, 24 are lowered to give the state of FIG. 6. In this state, the strengthened part 11 between the left and right electrodes 21, 22, 21, 22 is energized. As shown in FIG. 5, the steel plate 1 is heated until the strengthened part 11 reaches the quenching temperature (QT) while the non-strengthened parts 12, 13 remain at less than transformation start temperature ($AC_1$), then the energization is stopped to stop heating. The temperature retaining step of holding temperature at the quenching temperature (QT) for a predetermined time may be conducted after reaching the quenching temperature. Temperatures of the strengthened part 11 and the non-strengthened parts 12, 13 are measured individually by a non-contact type temperature sensor in a similar manner as described above. According to this, it is monitored whether or not the strengthened part 11 has reached the quenching temperature (QT) and whether or not the non-strengthened parts 12,13 remain at less than the transformation start temperature ($AC_1$).

In the entire cooling step, after removing the left and right upper electrodes 21, 21 from the steel plate 1 and stopping the heating, the steel plate 1 is moved to another pressing device (omitted in the drawing), and the steel plate 1 is sandwiched with a press die and rapidly cooled. According to this, the steel plate 1 is shaped simultaneously with hardening the strengthened part 11 and not hardening the non-strengthened parts 12, 13. Since the upper cooling block 23 and the lower cooling block 24 are displaced away from the steel plate 1 after completing the partial cooling step, it is possible to move the steel plate 1 from the heating device 2 to the pressing device rapidly. As a result, it is possible to minimize heat conduction from the strengthened part 11 having relatively high temperature to the non-strengthened parts 12,13.

Figure 9:
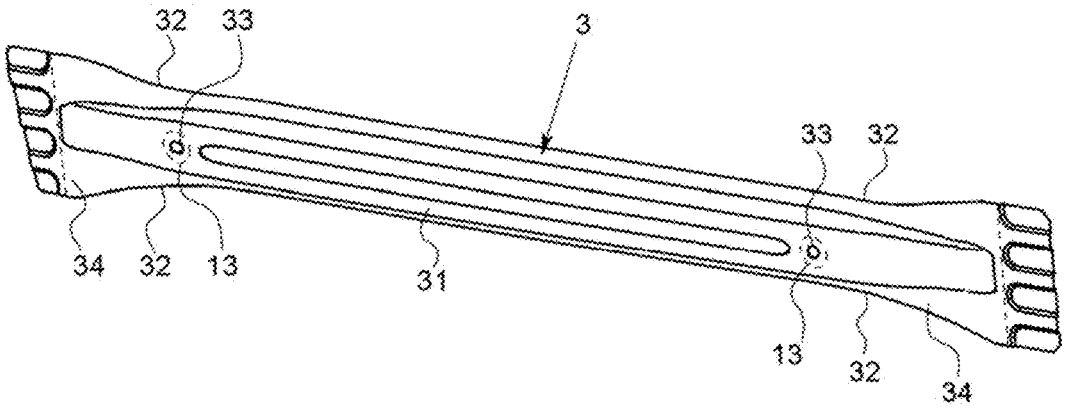
FIG. 9 is a perspective view illustrating an impact beam after hot press working.

Edges of the steel plate 1 are cut off through the hot press working. As a result, the impact beam 3 as illustrated in FIG. 8 and FIG. 9 is obtained. The strengthened part 11, which is hardened, becomes a main body. Edges of the non-strengthened part 14 and the non-strengthened part 12 are cut off to be the attachment parts 34. The through-hole 33 is provided on the non-strengthened part 13. The non-strengthened parts 12, 13, 14 are easy to be cutting-worked because they are not hardened, and can be finished with high accuracy.

EXAMPLES

The method for strengthening a steel plate member of the present invention is explained more specifically with examples.

Example 1

An impact beam illustrated in FIG. 8 and FIG. 9 was shaped using a steel plate corresponding to Deutsche Industrie Normen 22MnB5. Since the transformation start temperature ($AC_1$) of this steel plate was presented as 810 to 840° C., the non-quenching temperature (NQT) was set at 800° C. in the present example to leave a margin. Further, since its transformation end temperature ($AC_3$) was presented as 850° C., the quenching temperature (QT) was set at 930° C. in the present example. The temperature difference (ΔT) was 130° C.

This steel plate was laid across the left and right electrodes of the direct energization heating device as illustrated in FIG. 1 and others. The steel plate was sandwiched between upper and lower electrodes to apply electricity between the left and right electrodes. The energization was conducted so that the current value was 377 amperes. The temperature rising rate was 130° C./second. The energization was conducted in the state that the upper and lower cooling blocks are not in contact with the steel plate. In energization of 6.0 seconds, the temperature of the steel plate reached 800° C. which was the non-quenching temperature (NQT) (first heating step).

When the temperature of the steel plate reached 800° C., energization was suspended. Non-strengthened parts set in left and right end parts of the steel plate (reference numerals 12, 13 in FIG. 4) were sandwiched with upper and lower cooling blocks to contact end surfaces of the upper and lower cooling blocks for 1.5 seconds for conducting the partial cooling step. As the cooling block, the one having the shape illustrated in FIG. 3 made of copper was used for forming the non-strengthened parts 12, 13, 14 on the steel plate. The electrodes remained connected with the steel plate in the partial cooling step too. Water at room temperature was circulated in the conduit inside the cooling block. As a result of the partial cooling step, a temperature difference of 200° C. arose between the strengthened part and the non-strengthened part. The temperature was dropped by 200° C. in the present example to leave a margin with reference to the above explained QT−NQT=130° C. (ΔT). The time from starting of lowering or elevation of the upper and lower cooling blocks to displacement of the upper and lower cooling blocks away from the steel plate was 5.0 seconds.

After completing the partial cooling step, energization was started so that a current of 180 amperes flowed through the steel plate placed between the left and right electrodes. It was heated until the temperature of the strengthened part reached 930° C. which was the quenching temperature (QT) (second heating step). The temperature rising rate was 20° C./second. In 6.4 seconds after starting of energization, the temperature of the strengthened part reached 930° C. The temperature of the non-strengthened part after the second heating step was 770° C. which was lower than $AC_1$=810° C.

The steel plate after the second heating step was moved to the press device. A press die circulating water at room temperature was pressed against the steel plate for 12 seconds to form the shape of the impact beam illustrated in FIG. 8 and FIG. 9.

Figure 10:
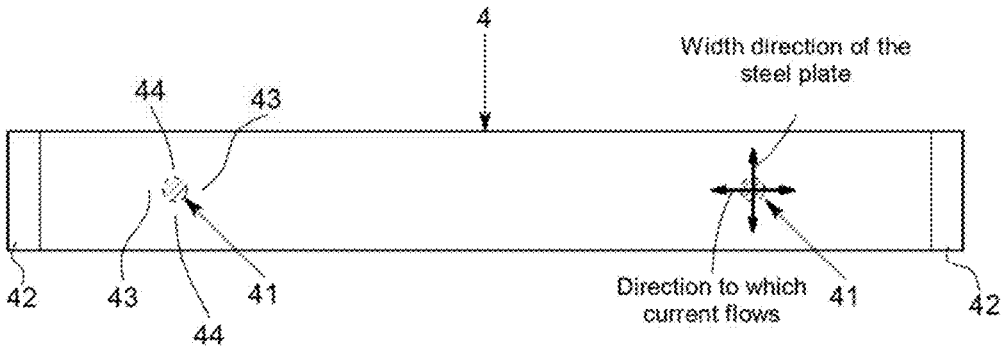
FIG. 10 is a plan view of a steel plate illustrating a position in which temperature is measured in Example 1 and Comparative Examples 1 and 2.
Figure 11:
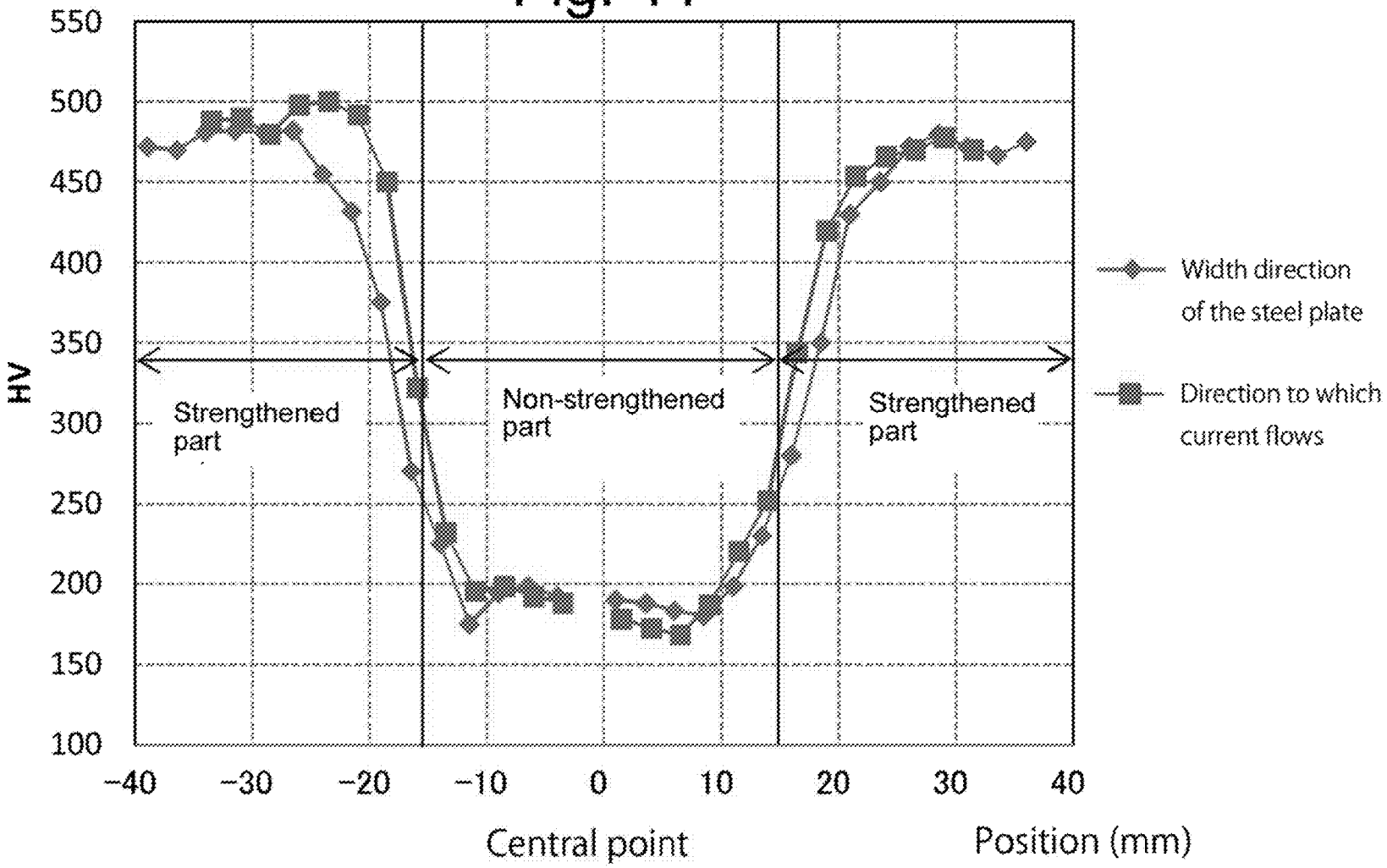
FIG. 11 is a graph showing a result of Vickers hardness test of Example 1.

For examining the effect of partial hardening, hardness of the non-strengthened part 13 for through-hole, which was provided in the steel plate of Example 1, was examined by a Vickers hardness test according to JIS2244. The result is shown in the graph of FIG. 11. The X-axis of the graph represents the position from the center of the non-strengthened part 41 as illustrated in FIG. 10. The rhombic marker indicates the widthwise position in the steel plate. The square marker indicates the position in which the current flows in the steel plate. The Y-axis of the graph represents Vichers hardness (HV).

In the steel plate of Example 1, a cylinder having a bottom face of 1.5 mm in radius was used as the cooling part. FIG. 11 reveals that inflection points of Vickers hardness appear at around −15 mm and 15 mm.

Comparative Example 1

A steel plate 4 identical to the steel plate used in Example 1 was heated until the temperature of the entire steel plate reached 920° C. in the condition that the steel plate was sandwiched from above and below with the pair of cooling parts. The cooling part which was a cylindrical member made of copper was used for forming a non-strengthened part 41. A pair of electrodes 4 were connected to the left and right end parts of the steel plate to flow a current and heat the steel plate. In order to evaluate if the steel plate 4 was evenly heated, temperatures of the left and right parts of the non-strengthened part 41 (position represented by reference numeral 43 in FIG. 10) and the upper and lower parts of the non-strengthened part 41 (position represented by reference numeral 44 in FIG. 10) were measured. The temperature of the left and right parts 43 of the non-strengthened part 41 was 1050° C., which was higher than the transformation end temperature ($AC_3$). However, it turned out that the temperature of the upper and lower parts 44 of the non-strengthened part 41 was 600° C., which was lower than the transformation start temperature ($AC_1$). It is inferred that this was based on the fact that difference in current density was generated by the cooling part made of copper. These proved that the steel plate was not evenly hardened with the method pressing the cooling part during heating.

Comparative Example 2

The steel plate 4 was heated to 920° C. in a similar manner to Comparative Example 1 except that the cooling part made of ceramics was used in place of copper of Comparative Example 1. In Comparative Example 2, the steel plate 4 was evenly heated. However, the cooling part was collapsed after heating, which proved that the cooling part had a problem in durability.

REFERENCE SIGN LIST

1 steel plate
11 strengthened part
12 non-strengthened part
13 non-strengthened part (for through-hole)
14 non-strengthened part (for attachment part)
2 heating device
21 upper electrode
22 lower electrode
23 upper cooling block
231 cooling part
232 cooling part (for through-hole)
233 conduit
24 lower cooling block
241 cooling part
242 cooling part (for through-hole)
243 conduit
25 device frame
26 beam
261 cylinder
262 cylinder
27 base
271 cylinder
3 impact beam
31 strengthened main body
32 circumferential edge
33 through-hole
34 attachment part
$AC_1$ transformation start temperature
$AC_3$ transformation end temperature
QT quenching temperature
NQT non-quenching temperature
ΔT temperature difference

The invention claimed is:

1. A method for strengthening a steel plate comprising the following steps in the following order:

a first heating step, wherein the entire steel plate is heated by flowing a current to the steel plate with a heating device to a non-quenching temperature (NQT) set at a temperature lower than a 840° C. and heating is suspended;

a partial cooling step, wherein a first part of the steel plate is cooled while the heating is suspended to generate a temperature difference (ΔT) between a second part of the steel plate that is not cooled and the first part of steel plate that is cooled, the temperature difference (ΔT) determined by subtracting the non-quenching temperature (NQT) from a quenching temperature (QT) that is higher than or equal to 850° C., the first part of the steel plate being cooled by contacting a cooling block against the first part of the steel plate while the steel plate is in contact with the heating device;

a second heating step, wherein the entire steel plate is again heated by flowing a current to the steel plate by the same heating device until the second part of the steel plate that was not cooled in the partial cooling step reaches the quenching temperature (QT) while the first part of the steel plate that was cooled in the partial cooling step remains at a temperature lower than 840° C., and an entire cooling step, wherein the entire steel plate is cooled by contacting a die for press-forming against the entire steel plate while heating is stopped, wherein, the first part of the steel plate that was cooled in the partial cooling step has lower Vickers hardness according to JIS2244 than the second part of the steel plate that was not cooled in the partial cooling step.

2. The method for strengthening a steel plate according to claim 1, wherein in the partial cooling step, an end surface of the cooling block is placed in contact with the first part of the steel plate while the heating is suspended to make the cooling block absorb heat and to cool the first part of the steel plate, and the cooling block is displaced to a position away from the steel plate once the temperature difference (ΔT) is achieved.

3. The method for strengthening a steel plate according to claim 1, wherein in the second heating step, the steel plate is heated by directly applying an electricity.

4. The method for strengthening a steel plate according to claim 1, wherein in the entire cooling step, the steel plate is press-formed concurrently while cooling.

5. The method for strengthening a steel plate according to claim 1, wherein during the second heating step, the temperature of the first part of the plate increases the same amount as the temperature of the second part of the plate increases.

6. The method for strengthening a steel plate according to claim 1, further comprising a temperature retaining step, wherein after the second heating step the temperature of the second part of the plate is retained at the temperature above the quenching temperature.

7. The method for strengthening a steel plate according to claim 2, wherein the cooling block includes a cooling medium circulating therein.

8. The method for strengthening a steel plate according to claim 6, wherein the temperature retaining step retains the temperature of the second part of the plate at or above the quenching temperature of 850° C. while retaining the temperature of the first part of the plate below the non-quenching temperature of 840° C. for a predetermined time.

* * * * *